US005870999A

United States Patent [19]

Matsuda

[11] Patent Number: 5,870,999

[45] Date of Patent: Feb. 16, 1999

[54] FUEL INJECTOR OF AN ENGINE FOR MODELS

[75] Inventor: Norio Matsuda, Chiba-ken, Japan

[73] Assignee: Futaba Denshi Kogyo K.K., Mobara, Japan

[21] Appl. No.: 845,138

[22] Filed: Apr. 21, 1997

[30] Foreign Application Priority Data

Apr. 19, 1996 [JP] Japan ..... 8-098582
May 21, 1996 [JP] Japan ..... 8-125988

[51] Int. Cl.[6] ..... F02M 37/04; F02B 33/04

[52] U.S. Cl. ..... 123/533; 123/531

[58] Field of Search ..... 123/531, 533, 123/446, 73 C, 73 CB, 73 CC

[56] References Cited

U.S. PATENT DOCUMENTS

| | | | |
|---|---|---|---|
| 4,712,524 | 12/1987 | Smith | 123/531 |
| 4,754,739 | 7/1988 | Czwienczek | 123/531 |
| 4,796,594 | 1/1989 | Duret | 123/531 |
| 4,841,942 | 6/1989 | McKay | 123/531 |
| 5,054,457 | 10/1991 | Sakamoto | 123/531 |
| 5,090,363 | 2/1992 | Duret | 123/531 |
| 5,463,997 | 11/1995 | Cutler | 123/531 |
| 5,488,933 | 2/1996 | Pham | 123/531 |

*Primary Examiner*—Carl S. Miller
*Attorney, Agent, or Firm*—Oblon, Spivak, McClelland, Maier & Neustadt, P.C.

[57] ABSTRACT

Fuel is supplied stably to the engine for models under severe operational conditions. The magnetic core 34 is inserted in the solenoid coil 32 in the box 31. The movable valve body 38 is provided in the box 31. The valve body 38 is pressed by the plate spring 44 so as to close the fuel injection opening 37. The check valve 24 is provided on the fuel feeding passage 48. The diaphragm partitions between the air pressure supply passage 25 and the internal of the box 31. The pulsatory air pressure of about 20 to 100 kPa generated in the crank chamber is applied to the fuel in the box 31 through the diaphragm 26. Fuel is introduced into the fuel injector without pressurization and confined by the check valve, and the fuel is pressurized using air which is not affected very much by the force due to acceleration. The air pipe 27 is fixed to the valve body 38 and diaphragm 26, and communicates between the air pressure supply passage 25 and fuel injection opening 37. The fuel introduced into the fuel injector 30 is confined by the check valve 24, and is pressurized with the pulsatory air pressure from the crank chamber at a constant pressure. When injection, air is injected and injected fuel changes to mist. The supply of fuel is stable even under severe operational conditions, the combustion efficiency is improved, and the output of the engine is increased.

8 Claims, 5 Drawing Sheets

FUEL INJECTOR OF AN ENGINE FOR MODELS

BACKGROUND OF THE INVENTION

This invention relates to a programmable fuel injector to be incorporated in an engine for models.

Conventionally, for glow engines of two-cycle or four-cycle which have been known as an engine for models, a carburetor 100 having the structure as shown in FIG. 5 has been used as the means for controlling the feeding rate of fuel to a combustion chamber of an engine.

In the housing 101 of the carburetor 100, a valve body 102 having the shape like a cylinder is provided rotatably around the axis line of the valve body 102 itself. Pipe conduits 101*a* and 101*b* extend vertically through the housing 101, and air is supplied from the upper pipe conduit 101*a*. A passage 102*a* extends through the valve body 102, and the passage is communicated to the pipe conduits 101*a* and 101*b* of the housing 101 with the opening depending on the rotation angle of the valve body 102. An operating arm 103 is connected to a portion of the valve body 102 which projects beyond the one end of the housing 101. An operating part of a servo mechanism not shown in the figure is connected to the operation arm 103, and the servo mechanism rotates the valve body 102 in the housing 101. A needle 104 is fixed to the valve body 102 with a screw, and the projection into the valve body 102 is adjustable by turning the needle 104.

A fuel control needle valve 105 is built-in at the other end of the housing 101. The needle valve 105 has a tube 106 and a needle 107 provided in the tube 106. The needle 107 is fixed to the tube 106 with a screw, and the needle 107 is moved in reverse in the tube 106 by turning a knob 108 provided at the base of the needle and the tip opening of the tube 106 can be adjusted. The tip of the needle 104 provided to the valve body 102 is facing to the opening of the tip of the tube 106 of the needle valve 105.

Fuel fed to the needle valve 105 is injected from the clearance between the tip of the tube 106 and the needle 107 to the internal, mixed with air supplied in the valve body 102, and fed to an engine. Because the flow rate of fuel can be adjusted by turning the knob of the needle valve 107, the flow rate of fuel (or air-fuel ratio) can be previously set so that the engine rotates at the maximum rotation speed. The servo mechanism rotates the valve body 102 to adjust air flow rate into the valve body 102, and controls the flow rate of fuel fed to the engine.

According to the carburetor 100, when the engine is operated to increase the rotation speed rapidly from the low rotation condition such as idling, a lot of air is fed in the valve body, but the supply of fuel can not follow the supply of air, and the balance of air-fuel ratio is unbalanced. The rotation of the engine increases not smoothly and increases slowly, and can be stopped in the bad case. As a whole, the response is not speedy, the transition from the low rotation speed to high rotation speed or the high rotation speed to low rotation speed requires a long time, it is a disadvantage of the conventional engines. Further, in the case that an engine for models is mounted on a radio control model plane, fuel is fed not adequately to the carburetor due to the adverse effect of centrifugal force caused by flying motion of the model plane, the inadequate feeding of fuel causes the malfunction of the engine.

It is an object of the present invention to provide a fuel injector which is capable of feeding fuel stably for maintaining the air-fuel balance and capable of deriving the stable and high performance of the engine for models used under the severe condition as an engine for models mounted on a radio control model plane for acrobatic flying such as loop flying.

SUMMARY OF THE INVENTION

The fuel injector of an engine for models, in which pressurized fed fuel is injected into the combustion chamber from the injection opening, is provided with a reverse flow preventing means for preventing reverse flow of the fuel, a flexible member for transmitting the pulsatory pressure in the crank chamber of the engine for models generated synchronously with the motion of the piston, and an air pipe for injecting air into the injection opening with aid of the pulsatory pressure transmitted from the crank chamber.

The fuel injector of an engine for models is the fuel injector of an engine for models, wherein the reverse flow preventing means is a check valve.

The fuel injector of an engine for models is the fuel injector of an engine for models, wherein the air pipe extends through the flexible member and communicates between the crank chamber and the injection opening.

The fuel injector of an engine for models is the fuel injector of an engine for models described in the claim 1, wherein the maximum pressure generated in the crank chamber of the engine for models ranges from 20 kPa to 100 kPa.

The fuel injector of an engine for models, in which pressurized fed fuel is injected into the combustion chamber from the injection opening, is provided with a box, a fuel feeding passage for guiding fuel into the box, a fuel injection orifice provided to the box, a solenoid coil provided in the box, a magnetic core provided in the solenoid coil, a valve body provided in the box and movable in the axial direction of the solenoid coil to the magnetic core magnetically by supplying power to the solenoid coil to open the fuel injection orifice, and a forcing means for exerting a force to press the valve body in the direction so as to close the fuel injection orifice, a check valve for preventing the fuel guided into the box from reversing into the fuel feeding passage, an air pressure supply passage for supplying the air pressure generated in the crank chamber of the engine for models into the box, a flexible member for applying the air pressure supplied through the air pressure supply passage to the fuel in the box, and an air pipe, which extends through the flexible member and the valve body so as to communicate between the air pressure supply passage and the injection opening, for injecting air into the injection opening with the pulsatory air pressure.

The fuel injector of an engine for models is the fuel injector of an engine for models, wherein the fuel injector is provided with a stroke detection means for detecting the operational cycle of the engine for models in order to output a stroke signal, and a control means for supplying power to the solenoid coil during a suction stroke of the engine for models in response to the stroke signal outputted from the stroke detection means.

The fuel injector of an engine for models is the fuel injector of an engine for models, wherein the fuel injector is provided with a box, a feeding passage for guiding fuel into the box, a fuel injection orifice, a solenoid coil provided in the box, a magnetic core provided in the solenoid coil, a valve body provided in the box and movable in the axial direction of the solenoid coil to the magnetic core magnetically by supplying power to the solenoid coil to open the fuel injection orifice, a forcing means for exerting a force to press the valve body in the direction so as to close the fuel injection orifice, and an air pipe for injecting air into the injection opening with the pulsatory air pressure supplied from the crank chamber.

The fuel injector of an engine for models is the fuel injector of an engine for models, wherein the pressing force of the forcing means is prescribed so as to be equivalent to the force exerted to the valve body by the fuel.

The fuel injector of an engine for models is the fuel injector of an engine for models, wherein the axial direction of the solenoid coil is in parallel to the movement direction of the model on which the engine for models is mounted, and the fuel injection opening of the solenoid coil is directed forward in the movement direction of the model.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
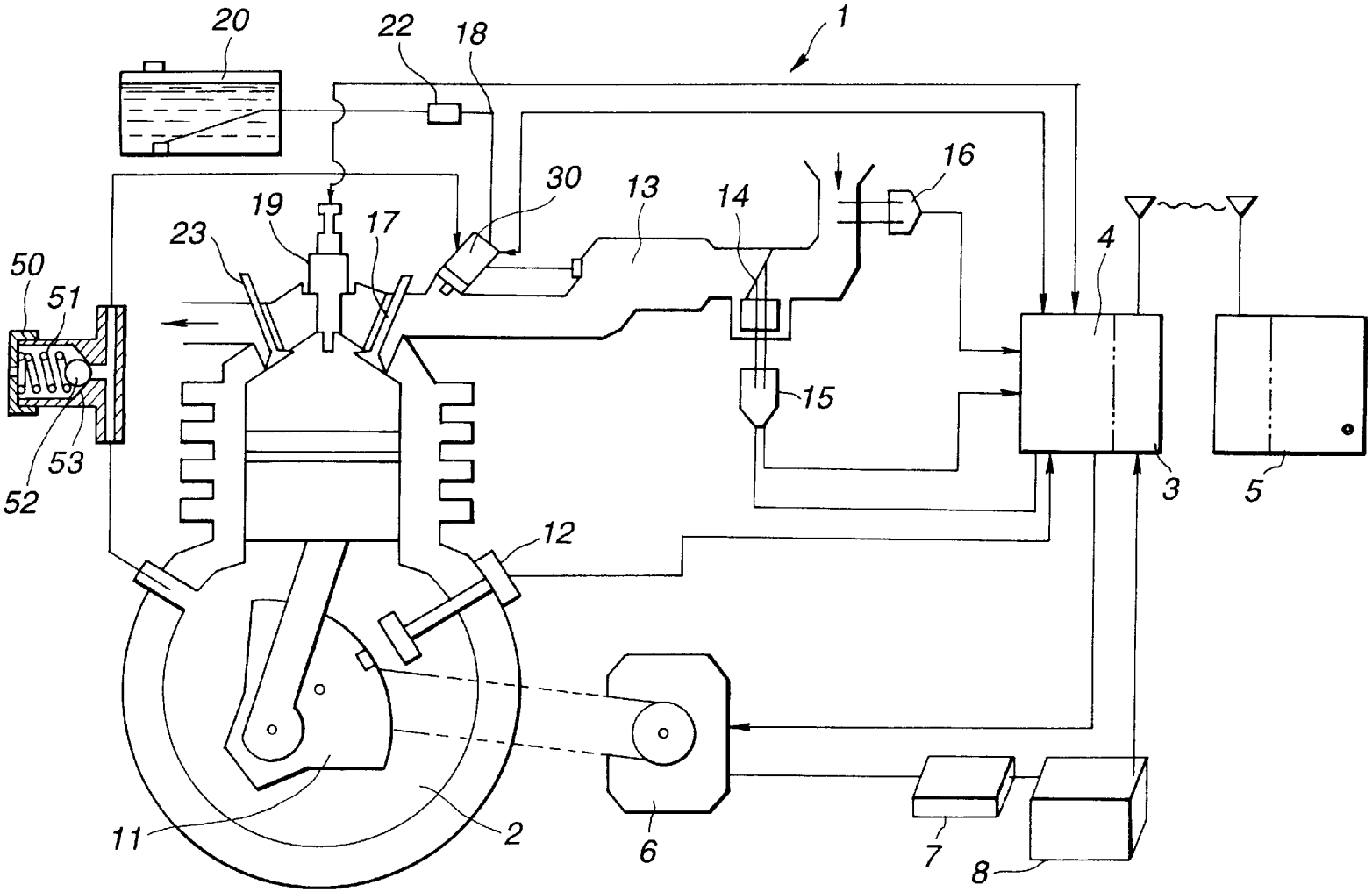
FIG. 1 is a schematic structure of an engine incorporated with a fuel injector of the first embodiment of the present invention.

The first embodiment of the present invention is described in detail hereinafter referring to FIG. 1 to FIG. 3. This embodiment involves an engine for models provided with a programmed fuel injector. The engine for models 1 (referred to as engine 1 hereinafter) of this embodiment is an engine to be mounted on a radio control model plane. The engine 1 shown in FIG. 1 is a four-cycle engine, and methyl alcohol fuel containing lubricating oil and ignition accelerating agent such as nitromethane is used for the engine 1. The capacity of the combustion chamber is in a range from 1 to 30 cc, and the pressure caused in the crank chamber 2 pulsates in a range from 20 kPa to 100 kPa for the peak value of positive pressure and in a range from −20 kPa to −100 kPa for the peak value of negative pressure. The positive pressure and negative pressure are the value based on the reference of the average pressure in the crank chamber.

The engine 1 is controlled by a control means 4 of a receiver 3 mounted on the radio control model plane. When an operator operates the transmitter 5, the receiver 3 receives radio wave from the transmitter 5, and the radio wave controls every parts of the model plane including the engine 1.

Figure 2:
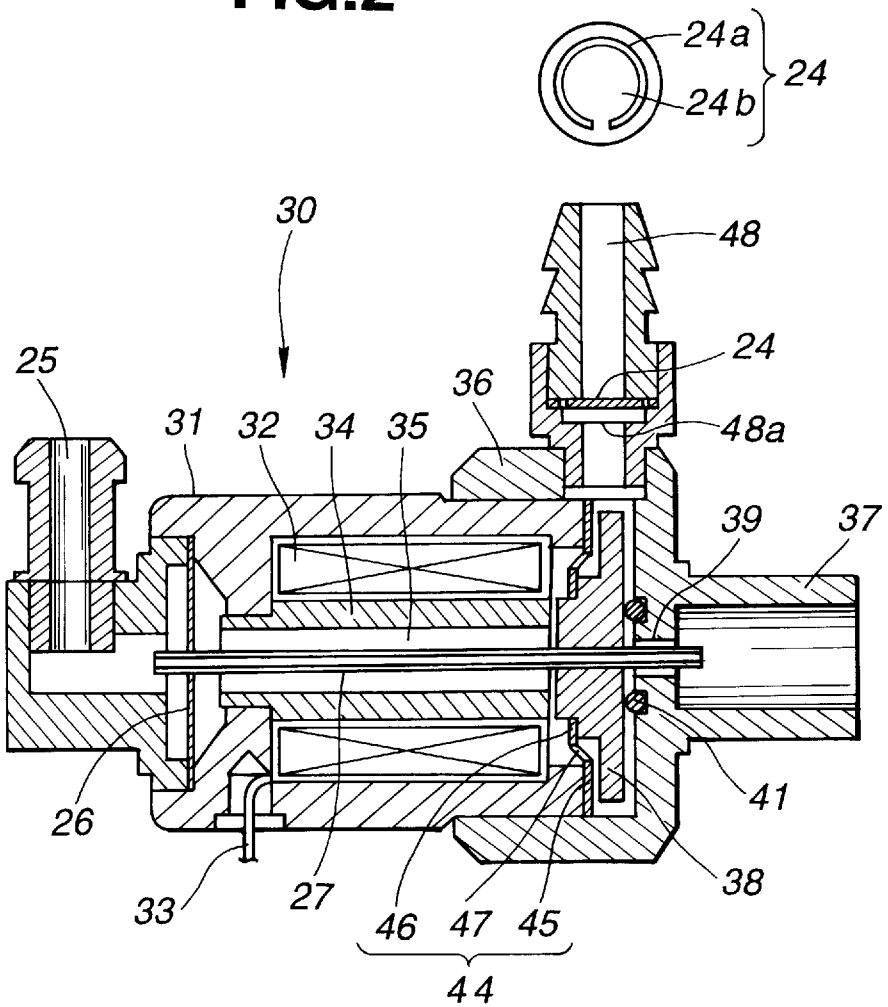
FIG. 2 is a cross-sectional view of the fuel injector of the first embodiment of the present invention.

The engine 1 shown in FIG. 2 is started up by a starter 6. The starter 6 is driven by power supplied from the battery 8 through a rectifier 7.

A rotational position sensor 12 for detecting the position of the rotating crank 11 is provided in the crank chamber 2 as a stroke detection means. The rotational position sensor 12 detects the driving cycle of the engine 1 for matching the fuel injection timing. The output signal outputted from the rotational position sensor 12 is sent to the control means 4 of the radio control receiver 3, and served to control the engine 1.

An intake manifold 13 of the engine 1 is provided with a throttle valve 14 for controlling intake air. The opening of the throttle valve 14 is controlled by the driving means 15.

The driving means 15 is controlled by the controller 4 of the radio control receiver 3. An intake air and temperature sensor 16 are provided at the air intake inlet of the intake manifold 13, the signal generated from the sensor is supplied to the control means 4 of the radio control receiver 3 and used for controlling the engine 1.

The fuel injector 30 is provided near the intake valve 17 of the intake manifold 13. The fuel injector 30 and a fuel tank 20 are connected with interposition of a filter 22. The fuel flows out from the fuel tank 20 and is supplied to the fuel injector 30 through the filter 22.

The crank chamber 2 and fuel injector 30 are connected with interposition of a pressure controller 50. The pressure controller 50 is a pressure control valve having a structure that a spring 51 presses elastically a ball 52 onto the seat surface 53. The pulsatory air pressure generated in the crank chamber 2 synchronously with the driving of the engine is applied to the fuel in the fuel injector 30. In this embodiment, the air pressure in the crank chamber 2 is used as a pressure means for pressurizing the fuel in the fuel injector 30. In detail, the air pressure in the crank chamber 2 is used as a pressure means for pressurizing the fuel in the fuel injector 30 in the embodiment, and the pulsatory air pressure having the peak value of positive pressure of about 20 kPa to 100 kPa and the peak value of negative pressure of about −0.5 kPa to −30 kPa is used. In the fuel injector 30 of the embodiment, the pulsatory air pressure renders the fuel injector 30 the pump function.

Next, the structure of the above-mentioned fuel injector 30 is described. As shown in FIG. 2, the fuel injector 30 has an approximately cylindrical box 31. In the box 31, a solenoid coil 32 is contained. The power source terminal 33 for supplying power to the solenoid coil 32 extends to the outside of the box 31 through the box 31. One end of a magnetic core 34 is inserted into the solenoid coil 32 up to the middle. On the center line of the magnetic core 34, a passage 35 of fuel is formed.

At the end of the valve box 36, a fuel injection opening 37 is formed. On the end face of the valve box 36, a fuel injection opening 37 is formed. The fuel injection opening 37 communicates to the internal of the valve box 36 through the fuel injection orifice 39. On the inside surface of the valve box 36 surrounding the fuel injection orifice 39, a ring seal member 41 is attached. In the valve box 36, a disk valve body 38 is provided movably adjacent to the end of the magnetic core 34. Between the front end of the box 31 and the back side of the valve body 38, a plate spring 44 is provided as a forcing means for pressing the valve body 38 toward the fuel injection orifice 39. The plate spring 44 comprises a ring-shaped outside fixing part 45, a ring-shaped inside moving part 46, and a connecting part 47 for connecting elastically both parts. The fixing part 45 is engaged with the front end of the box 31, and the moving part 46 is engaged with the step portion provided on the back side of the valve body 38. The valve body 38 is pressed by the plate spring 44 tightly onto the seal member 41, and closes the fuel injection orifice 39.

A fuel feeding passage 48 is provided on the side peripheral surface of the valve box 36 for communicating to the outside. The fuel feeding passage 48 is connected to the fuel feeding pipe conduit 18 guided from the fuel tank 20 and guides fuel to the internal of the valve box 36 and to the said flow passage 35 in the box 31.

In the fuel feeding passage 48, a check valve 24 is provided as a reverse flow preventing means for preventing reverse flow of the fuel fed into the box 31 and the valve box 36 to the outside. As shown in FIG. 2, the check valve 24 is a plate like approximately circular member having a prescribed elasticity, and on the central portion of the check valve 24, a circular hole 24*a* and an approximately circular valve member 24*b* for controlling the opening of the hole 24*a* which valve member 24*b* continues partially to the edge of the hole 24*a* are formed. The inside diameter of the fuel feeding passage 48 provided outside the check valve 24 and in contact with the check valve 24 is narrower than the outside diameter of the valve 24*b* of the check valve 24, and a gap portion 48*a* having an inside diameter wider than the outside diameter of the valve member 24*b* of the check valve 24 is formed in the fuel feeding passage 48 on the inside of the check valve 24. Therefore, the valve member 24*b* of the check valve 24 can not open to the outside, and the fuel in the box 31 will not flow to the outside of the box 31. To the contrary, the valve member 24*b* of the check valve 24 provided at the gap portion 48*a* can open to the inside of the valve box 36, and thus the fuel fed from the external can be introduced into the valve box 36 smoothly.

On the rear end face of the box 31 which is the position opposite to said fuel injection opening 37, air pressure supply passage 25 is formed for applying the air pressure to the fuel in the box 31. The outside end of the air pressure supply passage 25 is connected to the crank chamber 2 of the engine as described hereinbefore. Between the air pressure supply passage 25 and the box 31, a diaphragm 26 consisting of a flexible material is provided. The diaphragm 26 used in this embodiment consists of, for example, silicone rubber film. The diaphragm 26 defines substantially between the air pressure supply passage 25 and the internal of the box 31 air-tightly. The pulsatory pressure generated in the crank chamber 2 of the engine for models with motion of the piston is transmitted to the fuel in the box 31 through the diaphragm 26.

In the pressure controller 50, the elastic force of the spring 51 which presses the ball 52 onto the seat surface 53 is constant, the positive pressure from the crank chamber 2 will not exceeds a prescribed pressure, and the pressure is controlled at a constant pressure. Thereby, the fuel injection pressure of the fuel injection valve 30 is maintained at an approximately constant value. When the negative pressure is generated in the crank chamber, the ball remains on the seat surface 53 in contact, and the maximum negative pressure is supplied to the fuel injector 30. Thus, the diaphragm 26 is drawn with the maximum negative pressure and fuel is sucked.

An air pipe 27 is provided in the flow passage 35 in the box 31. The rear end of the air pipe 27 penetrates air-tightly through the diaphragm 26, and fixed to the diaphragm 26. The front end of the air pipe 27 penetrates through the center of the valve body 38, and fixed to the valve body 38. The tip of the air pipe 28 which penetrates the valve body extends to the inside of the fuel injection opening 37 through the fuel injection orifice 39. The air pressure supply passage 25 communicates to the fuel injection opening 37 by way of the air pipe 27, and pulsatory air supplied from the air pressure supply passage 25 is injected into the fuel injection opening through the air pipe 27.

Next, operations of the embodiment are described.

Figure 3:
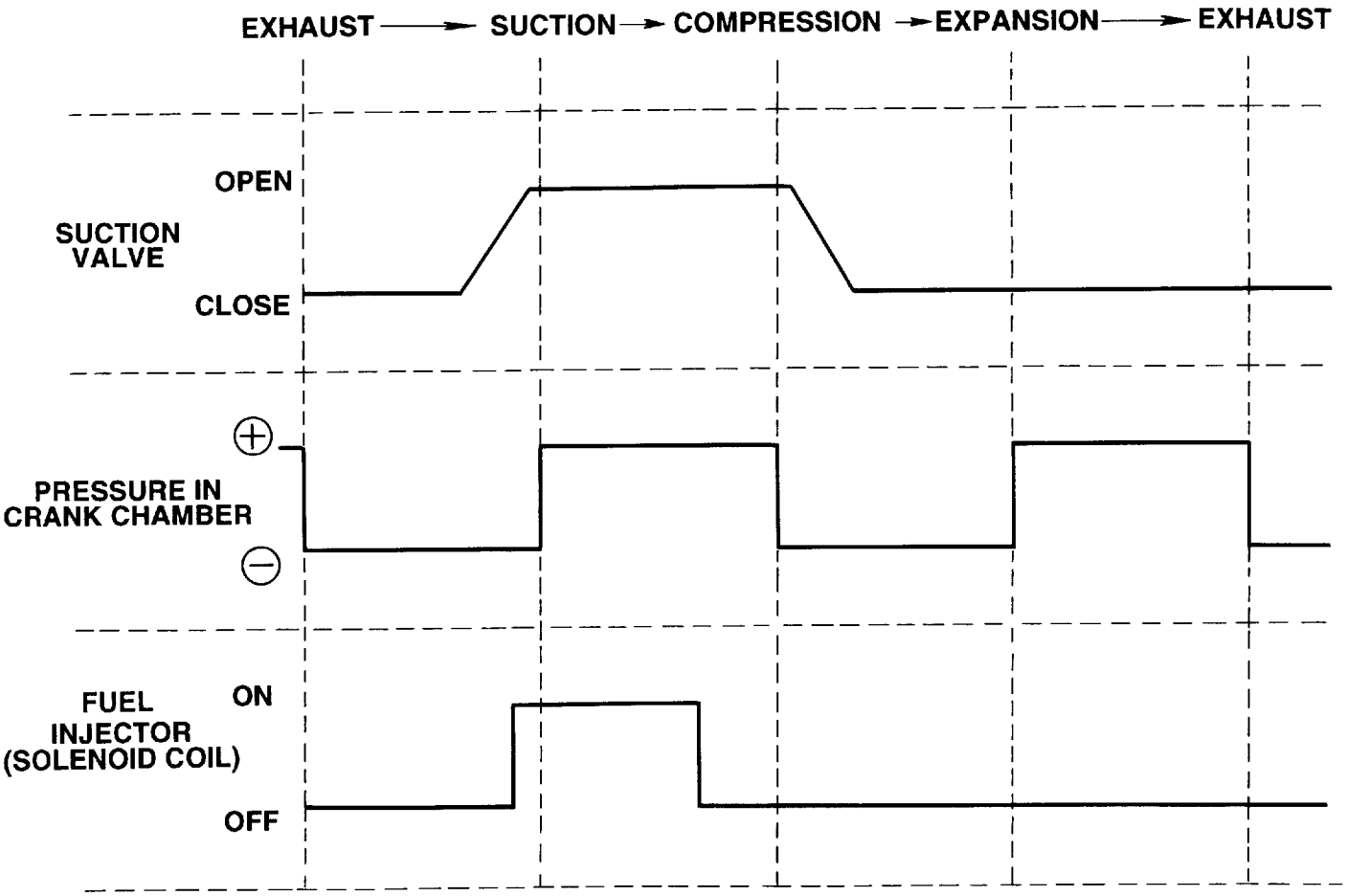
FIG. 3 is a diagram for illustrating the timing of the operation of the engine, pressure change in the crank chamber, and operation of the fuel injector of the first embodiment of the present invention.

As shown in FIG. 3, the engine 1 for models of the embodiment repeats suction, compression, expansion, and exhaust strokes to continue the operation. The pressure in the crank chamber 2 changes as the piston reciprocates during operation. The pressure in the crank chamber 2 decreases while the piston goes up during an exhaust stroke. The pressure in the crank chamber 2 increases while the piston goes down during a suction stroke. The pressure in the crank chamber 2 decreases while the piston goes up during a compression stroke. The pressure in the crank chamber 2 increases while the piston goes down during an expansion stroke. As described herein above, pulsatory pressure (air pressure) is generated in the crank chamber 2 correspondingly to the motion of the piston. The pulsatory pressure changes approximately in a range of the positive peak pressure from 20 kPa to 100 kPa and the negative peak pressure from −20 kPa to −100 kPa referring to the average pressure in the crank chamber 2.

The pulsatory pressure supplied from the crank chamber 2 is supplied to the air pressure supply passage 25 of the fuel injector 30. The air pressure is applied to the diaphragm 26, and pressurizes the fuel in the box 31. When the air pressure becomes negative, the diaphragm 26 is pulled to the left side in FIG. 2. When, the check valve 24 is opened and fuel is sucked from the fuel feeding passage 48 into the box 31. When the air pressure becomes positive, the diaphragm 26 is pushed to the right side. Though the fuel in the box 31 is pressurized, the check valve is closed and does not allow the fuel to flow to the outside, and the fuel is stopped. The above-mentioned operations are repeated continuously, fuel is filled in the box 31 and in valve box 36, thus the fuel is maintained in constantly pressurized condition. The fuel filled in the fuel injector 30 is pressurized with a pressure approximately equal to the pressure generated in the crank chamber 2.

The fuel injector 30 filled with constantly pressurized fuel is driven to inject fuel. In the fuel injector 30, while power is not supplied to the solenoid coil 32, the valve body 38 is pressed to the fuel injection orifice 39 by the pressing force of the plate spring 44, the front face of the valve body 38 is brought into contact with the seal member 41 to close the fuel injection orifice 39. When power is supplied to the solenoid coil, the solenoid coil pulls magnetically the valve body 38 toward the magnetic core 34 against the forcing force of the plate spring 44. A clearance is formed between the valve body 38 and the inside surface of the valve box 36. The fuel in the box 31 and valve box 36 is injected forward from the fuel injection orifice 39 to the outside of the valve box 36.

The driving of the fuel injector 30 is controlled by the controller 4. The injection timing of fuel is determined by the rotational position sensor 12 for detecting the position of the crank 11. The rotational position sensor 12 detects the position of the crank 11, when the rotational position sensor 12 detects a suitable timing between the starting of opening of the intake valve 17 and the full opening of the intake valve 17, the rotational position sensor 12 outputs a signal to the controller 4, and in response to the signal, the controller 4 supplies power to the solenoid coil 32 of the fuel injector 30 to inject fuel as shown in FIG. 3. The quantity of fuel injection is determined depending on the opening of the throttle valve 14, the quantity of intake air from the air inlet of the intake manifold 13, and signal from the temperature sensor 16.

At the same time of the fuel injection, air is injected from the air pipe 27 to the fuel injection opening 37 with the pressure from the crank chamber 2. The injected fuel is atomized with air from the air pipe 27.

The fuel injected from the fuel injector 30 is mixed with intake air supplied depending on the opening of the throttle valve 14, and the mixture is supplied into the cylinder through the intake valve 17 which opens at the prescribed timing. The glow plug 19 ignites the mixture at the prescribed timing, and a combustion starts. Burnt gas is exhausted to the outside of the cylinder through the exhaust valve 23 which opens at the prescribed timing.

In this embodiment, because fuel is pressurized at a constant pressure with the air pressure in the crank chamber 2, the injection is stable. Further, because the injected fuel is mixed with air supplied from the air pipe 27 in a form of mist, the fuel is supplied consistently to the combustion chamber without adhering on the intake manifold 13 and intake valve 17, and the combustion efficiency is improved. Because the air pipe 27 serves the function to allow the air confined in the crank chamber 2 to release to the outside, the releasing decreases the resistance for reciprocation of the piston, the decreased resistance improves the engine efficiency. Further, because the air pipe is fixed to the diaphragm 26 and valve body 38, when the diaphragm 26 is actuated by the pulsatory air pressure from the crank chamber 2, the valve body 38 is linked to the movement of the diaphragm 26 through the air pipe 27. Thereby, the valve body 38, which opens and closes the fuel injection orifice 39, is favored to move by the driving of the engine synchronously, then the operational response of the fuel injector 30 is improved.

In the fuel injector 30 of the embodiment, the pulsatory air pressure has the peak value of positive pressure ranging from about 20 kPa to 100 kPa and the negative pressure ranging from about −0.5 kPa to −30 kPa. The fuel pressure in a fuel injector of an actual vehicle ranges from 250 kPa to 300 kPa, that is, the fuel pressure of the embodiment is ⅓ to 1/13 times that of actual vehicle, considerably lower than that of an actual vehicle. Therefore, only the low pressure which the plate spring 44 exerts onto the valve body 38 is sufficient, and the plate spring 44 which can cause only a reduced elastic force (the peak value of positive pressure is 20 kPa to 100 kPa and the peak value of negative pressure is −0.5 kPa to −30 kPa, therefore the elastic force which can endure the pressure fluctuation is smaller than 100 kPa) which can endure the same pressure fluctuation as applied to fuel may be used sufficiently to stop the flow of fuel. The displacement is small and the pressure applied to fuel is low, and thus the solenoid coil for moving the valve body 38 and the plate spring 44 may be small sized.

A radio control model plane on which an engine for models having the fuel injector 30 of the embodiment is mounted performs often acrobatic flying such as loop flying which an actual plane seldom performs. Under such severe flying condition, the feeding of fuel to a fuel injector is apt to be unstable. In detail, the fuel in a fuel tank and the fuel in a fuel feeding pipe conduit which connects between a fuel tank and the fuel injector are affected by gravity and centrifugal force due to exquisite operations of the model plane, and the magnitude and direction of the centrifugal force change rapidly. The pressure applied to the fuel fed in the fuel injector can not be maintained constant, and in the engine mounted on the model plane, fuel can be affected by the centrifugal force and gravity to result in unstable feeding of fuel.

However, according to the fuel injector 30 of the embodiment, because the fuel filled once in the fuel injector 30 is confined by the check valve 24, and the fuel will not flow reversely from the fuel injector 30 regardless of changing of the pressure applied to the fuel fed to the fuel injector 30 due to the above-mentioned external cause, and the fuel is pressurized at a constant pressure by the pulsatory air pressure generated in the crank chamber 2 through the diaphragm 26.

Further, the fuel injector 30 is actuated during suction stroke (in some cases, the fuel injector 30 is actuated just before suction stroke in view of operating time), and this engine 1 is a four-cycle engine, therefore, the pressure in the cylinder is lowered during a suction stroke, on the other hand, the pressure in the crank chamber 2 turns to increase. Because fuel is injected when the pressure in the crank chamber 2 exceeds the pressure in the cylinder, by applying a pressure equivalent to the pressure in the crank chamber 2 to fuel, the fuel is injected efficiently into the cylinder. Further, the injected fuel is changed to mist with aid of the air injected from the air pipe 27, thereby the combustion efficiency is improved and the output of the engine for models is boosted.

The centrifugal force caused by wight and acceleration and deceleration is larger as the density of an object to which a force is exerted is larger. Generally, the density of fuel used for model planes is 800 to 900 kg/m$^3$ and the density of air is 1 to 1.3 kg/m$^3$, the difference between both densities is large. In other words, air is not affected very much by the force due to acceleration in comparison with fuel. The fuel injector 30 of the embodiment utilizes this principle. In detail, fuel is not pressurized with a high pressure but, fuel is introduced into the fuel injector 30 and confined by the check valve 24, and fuel is pressurized by air which is not affected by the force due to acceleration, particularly by the pulsatory air pressure from the crank chamber 2. This principle is the feature of the present invention. According to the engine for models 1 having the fuel injector 30 of the embodiment, the supply of fuel is stable even under the severe operational conditions, and the engine 1 will not stall due to insufficient fuel and excessive fuel.

In respective embodiments, the fuel injector 30 is used for an engine mounted on a radio control model plane only for description, however, the model in the present invention includes not only radio control model planes for hobby but also moving articles having an engine used for general industrial use, and includes model vehicles and model boats.

Figure 4:
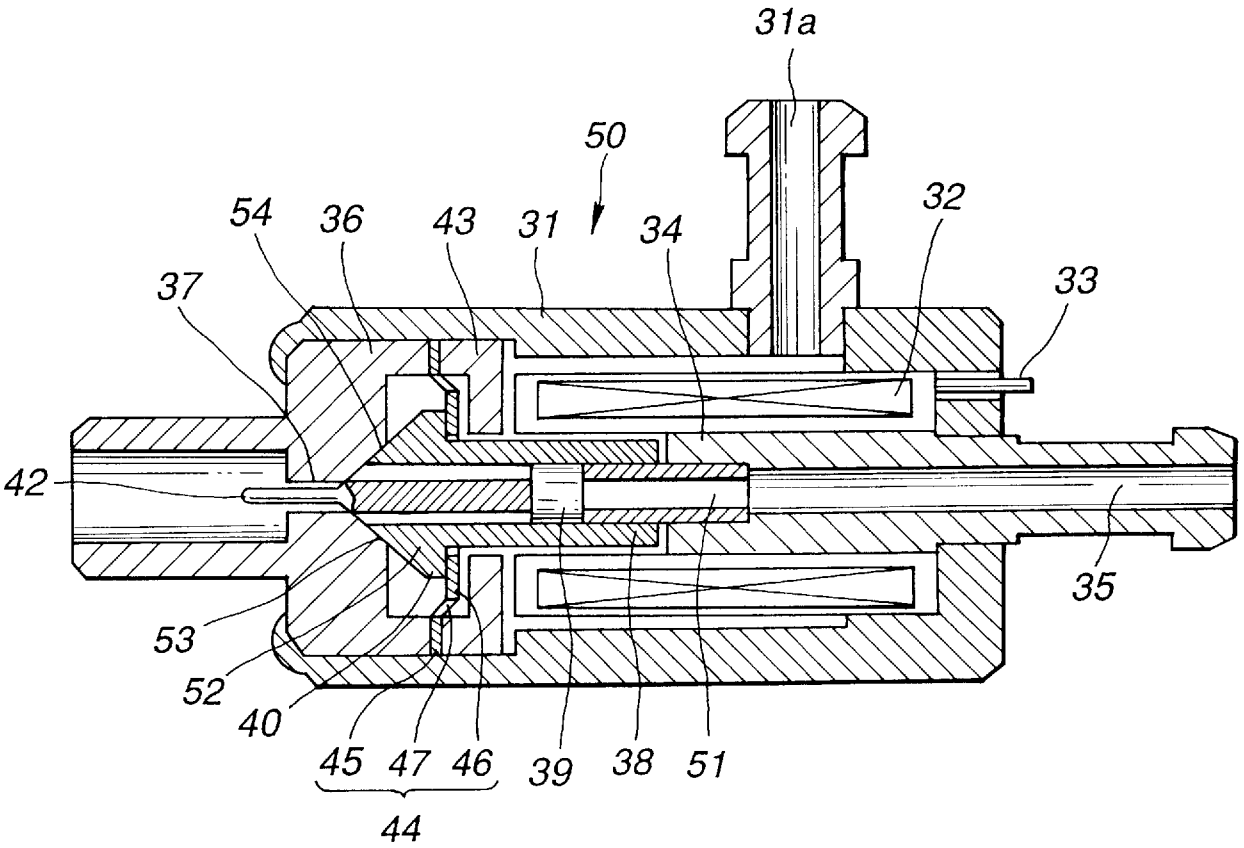
FIG. 4 is a cross-sectional view of the fuel injector of the second embodiment of the present invention.
Figure 5:
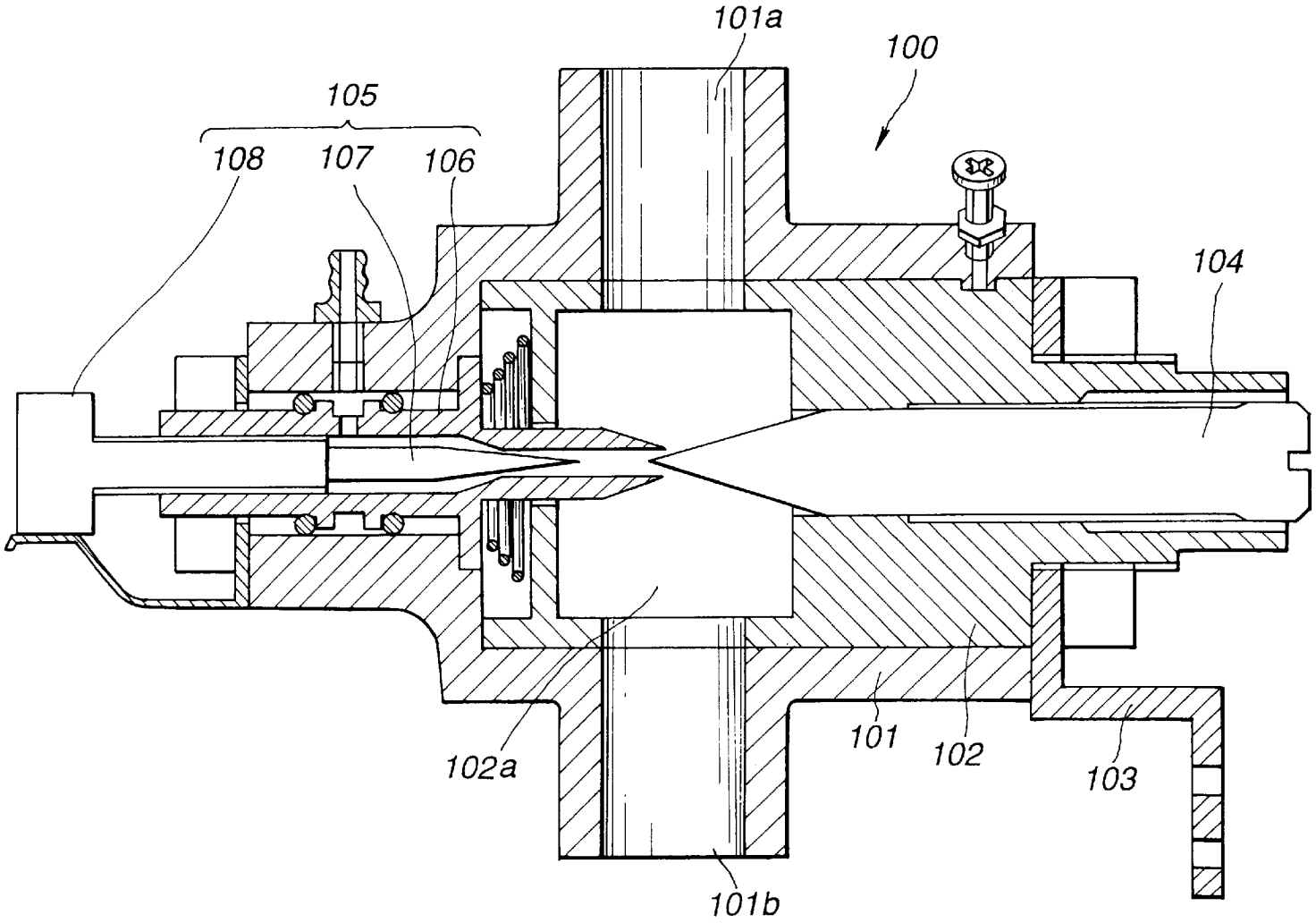
FIG. 5 is a cross-sectional view of a conventional carburetor.

The second embodiment of the invention is described referring to FIG. 4. The engine 1 to which the fuel injector 50 is applied and the model on which the engine 1 is mounted are same as those described in the first embodiment.

In the fuel injector 50 shown in FIG. 4, the same functionally equivalent components as those of fuel injector 30 of the first embodiment are given the same characters as used in FIG. 2, and detailed description is omitted.

An air inlet 31*a* is provided on the side peripheral surface of the box 31 for connecting and communicating to the air bomb 9 or the crank chamber 2 in order to introduce air pressure into the box 31. A fuel feeding pipe 18 guided from the fuel tank 20 is connected to a fuel feeding passage 35 formed in the magnetic core 34 of the solenoid coil 32. Pressurized air introduced from the air bomb 9 or the crank chamber 2 of the engine 1 is introduced into the fuel tank 20 like the first embodiment, and fuel is pressurized with a low pressure.

One end of a connecting tube 51 is connected to one end of the magnetic core 34 of the solenoid coil 32. The other end of the connecting tube 51 is inserted slidably to the passage 39 of the valve body 38. The front face of the head 52 of the valve body 38 is formed in a shape of conical surface 53 to serve for sealing, and this sealing surface 53 is similar to the concave conical surface 54 formed on the valve box 36. The passage 39 of the valve body 38 is branched and opens to the sealing surface 53. The needle 42 is provided on the end of the valve body 38, and inserted into the fuel injection orifice 37 of the valve box 36.

Between the fixing member 43 of the solenoid coil 32 and the valve box 36, the plate spring 44 is provided as a forcing means for pressing the valve body 38 in the direction of the fuel injection orifice 37. The fixing part of the plate spring 44 is fixed between the fixing member of the solenoid coil 32 and the valve box 36, and the moving part of the plate spring 44 is engaged with the head of the flange 40 of the valve body 38.

When power is supplied to the solenoid coil 32, the magnetic core 34 pulls the valve body 38 against the repulsion elastic force of the plate spring 44 to form a clearance between the sealing surface 53 and the conical surface 54 of the valve box 36. The pressurized fuel supplied into the box 31 is injected together with pressurized air from the fuel injecting orifice 37 to the outside of the box 31 with the same pressure synchronously with fuel injection timing. When, because the flow of the pressurized air is fast, the air flow acts so as to suck out the fuel to the outside of the box 31. Therefore in this embodiment, the pressurized fuel supplied into the fuel injector 50 is mixed to a some extent with pressurized air introduced from the pressure supplying means to the box 31, and then injected from the fuel injecting orifice 37 in a form of mist, thereby the combustion efficiency of the engine 1 is improved.

As described herein above, this fuel injector 50 provides a function like that of a carburetor used for the conventional engines, the action of supercharging is obtained by controlling the feeding of air relatively to the feeding of fuel, and the power of the engine 1 can be boosted up.

The fuel injector 50 of the embodiment is incorporated in the engine 1 mounted on a model plane, therefore fuel can be fed insufficiently due to the adverse effect of centrifugal force and gravity. However, air which has a low specific gravity and is not affected very much by centrifugal force and gravity is fed to the fuel injector 50 with the same pressure as that of fuel. The just required quantity of fuel is fed into the fuel injector 50 because of combum effect of air regardless of centrifugal force due to flying movement of the model plane and gravity.

While power is not supplied to the solenoid coil 32, pressurized air guided into the box 31 exerts a force on the flange 40 of the head of the valve body 38 to push the valve body 38 in the direction so as to close the fuel injection orifice 37. Also the plate spring 44 pushes the valve body 38 in the direction so as to close the fuel injection orifice 37. Thereby, the fuel injection orifice 37 is closed consistently while fuel is not injected and the fuel will not leak.

The fuel injector of the present invention is applied not only to four-cycle engines but also to two-cycle engines and other various types of engines.

In the case that the fuel injector of the present invention is applied to a two-cycle engine, because a suction stroke and compression stroke are operated simultaneously in a two-cycle engine, fuel is injected into the crank chamber during a compression stroke (in some cases fuel is injected during an exhausting/scavenging stroke in view of delayed operation of the fuel injector). When, the pressure in the crank chamber is lower than the fuel pressure in the fuel injector, but the fuel in the fuel injector is maintained at a pressure higher than the pressure in the crank chamber by the check valve, and therefore the fuel is injected with the high pressure as it is. The fuel injector can inject fuel efficiently.

The absolute value of the positive pressure and negative pressure generated in the crank chamber are almost equal each other in the case of a four-cycle engine, but are different in the case of a two-cycle engine. In the case of a two-cycle engine, because air flows into the crank chamber during a compression stroke, the absolute value of the negative pressure peak generated during a compression stroke is lower than the absolute value of the positive pressure generated in the crank chamber during an expansion stroke.

According to the engine of the present invention, fuel is confined in the internal by the reverse flow preventing means, the fuel is constantly pressurized by the pulsatory air pressure from the crank chamber of the engine, and injected into the combustion chamber of the engine, simultaneously the pulsatory air from the crank chamber is injected from the air pipe 27 with the fuel, thus the present invention provides the following effects.

(1) The structure of the fuel supply system is simplified because a fuel pressurizing device is not required.

(2) The fuel pressure does not fluctuate due to external cause because the air pressure from the crank chamber is used, therefore in the engine for models which is operated under severe service conditions, fuel can be fed stably, the balance of air-fuel ratio is maintained, and the engine exhibits stable and high performance.

(3) Because the air pressure obtained from the crank chamber of the engine for models is low, respective structural members of the fuel injector which utilizes the above-mentioned air pressure for pressurizing fuel are made small sized and light weight, and the fuel injector consumes less power.

(4) The air pipe 27 favors the injected fuel to be atomized, thereby the combustion efficiency is improved and the output of the engine is boosted up.

(5) Air is over charged from the air pipe 27, thereby the output of the engine is boosted up.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel injector in an engine for models having a combustion chamber, a crank chamber, and a piston said fuel injector comprising a fuel injection opening, a reverse flow preventing means for preventing reverse flow of fuel, a flexible member for transmitting pulsatory pressure in the crank member of said engine for models generated synchronously with motion of the piston, and an air pipe extending through said flexible member and communicating between said crank chamber and said fuel injection opening for injecting air into said fuel injection opening with the aid of the pulsatory pressure transmitted from said crank chamber.

2. The fuel injector as claimed in claim 1, wherein said reverse flow preventing means is a check valve.

3. The fuel injector as claimed in claim 1, wherein a maximum pressure generated in said crank chamber of the engine for models ranges from 20 kPa to 100 kPa.

4. A fuel injector in an engine for models having a combustion chamber and a crank member, said fuel injector comprising a box, a fuel feeding passage for guiding fuel into said box a fuel injection orifice provided in said box, a solenoid coil provided in said box, a magnetic core provided in said solenoid coil, a valve body provided in said box and movable in an axial direction of said solenoid coil toward said magnetic core magnetically by supplying power to said solenoid coil to open said fuel injection orifice, and biasing means for exerting a force to press said valve body in the direction so as to close said fuel injection orifice, a check valve for preventing the fuel guided into said box from reversing into said fuel feeding passage, an air pressure supply passage for supplying pulsatory air pressure generated in the crank member of the engine for models into said box, a flexible member for applying the pulsatory air pressure supplied through said air pressure supply passage to fuel in said box, and an air pipe extending through said flexible member and said valve body so as to communicate between said air pressure supply passage and said injection opening for injecting air into said injection opening with said pulsatory air pressure.

5. The fuel injector as claimed in claim 4, further comprising a stroke detection means for detecting an operational cycle of said engine for models in order to output a stroke signal, and a control means for supplying power to said solenoid coil during a suction stroke of said engine for models in response to the stroke signal outputted from said stroke detection means.

6. A fuel injector in a model aircraft engine having a combustion chamber and a crank chamber, the fuel injector comprising a box, a solenoid coil and a magnetic core provided in said box, a fuel feeding passage for introducing pressurized fuel with a pressure equivalent to a pressure generated in the crank chamber into said box, an air inlet for introducing pressurized air into said box, a fuel injection orifice for injecting the pressurized fuel into said combustion chamber, a valve body provided in said box and movable in an axial direction of said solenoid coil to said magnetic core magnetically by supplying power to said solenoid coil to open said fuel injection orifice and to permit said air inlet to communicate with said fuel injection orifice, and biasing means for exerting a force to press said valve body in a direction of closing of said fuel injection orifice.

7. The fuel injector as claimed in claim 6, wherein the pressing force of said element exerting a force is equivalent to the force exerted to said valve body by said fuel.

8. The fuel injector as claimed in claim 6, wherein the axial direction of said solenoid coil is disposed in parallel to movement direction of the model on which said engine for models is mounted, and the fuel injeciton orifice of said solenoid coil is directed forward in the movement direction of the model.

* * * * *